US012728337B2

(12) United States Patent
Leavitt

(10) Patent No.: US 12,728,337 B2
(45) Date of Patent: Sep. 8, 2026

(54) EXERCISE APPARATUS

(71) Applicant: Core Health & Fitness, LLC, Vancouver, WA (US)

(72) Inventor: Jeremy M. Leavitt, Vancouver, WA (US)

(73) Assignee: CORE HEALTH & FITNESS, LLC, Vancouver, WA (US)

( * ) Notice: Subject to any disclaimer, the term of this patent is extended or adjusted under 35 U.S.C. 154(b) by 145 days.

(21) Appl. No.: 18/730,277

(22) PCT Filed: Jan. 18, 2023

(86) PCT No.: PCT/US2023/011078

§ 371 (c)(1),
(2) Date: Jul. 18, 2024

(87) PCT Pub. No.: WO2023/141178

PCT Pub. Date: Jul. 27, 2023

(65) Prior Publication Data

US 2025/0144463 A1 May 8, 2025

Related U.S. Application Data

(60) Provisional application No. 63/300,784, filed on Jan. 19, 2022.

(51) Int. Cl.

| | |
|---|---|
| ***A63B 69/22*** | (2006.01) |
| ***A63B 21/00*** | (2006.01) |
| ***A63B 21/06*** | (2006.01) |

(52) U.S. Cl.

CPC ..... *A63B 69/222* (2022.08); *A63B 21/0602* (2013.01); *A63B 21/4035* (2015.10)

(58) Field of Classification Search

CPC ..... A63B 69/222; A63B 21/0602; A63B 21/4035; A63B 69/24; A63B 2071/026

See application file for complete search history.

(56) References Cited

U.S. PATENT DOCUMENTS

| | | | | |
|---|---|---|---|---|
| 3,166,317 | A | 1/1965 | Tumelson | |
| 5,803,877 | A | 9/1998 | Franey | |
| 6,027,435 | A * | 2/2000 | Nadorf | A63B 69/224 482/146 |
| 7,044,895 | B1 | 5/2006 | Iglehart | |
| 7,357,760 | B1 * | 4/2008 | Rios | A63B 69/22 482/90 |

(Continued)

FOREIGN PATENT DOCUMENTS

| | | | |
|---|---|---|---|
| CN | 114712823 | A | 7/2022 |

OTHER PUBLICATIONS

International Search Report and Written Opinion issued for PCT App. No. PCT/US2023/011078 dated Apr. 13, 2023 (11 pages).

*Primary Examiner* — Andrew S Lo

(74) *Attorney, Agent, or Firm* — Sand, Sebolt & Wernow Co., LPA

(57) ABSTRACT

An exercise apparatus can include a base. The exercise apparatus can include a post comprising a first portion and a second portion. The base can be configured to receive the first portion of the post. The exercise apparatus can include a pad disposed around the second portion of the post. The exercise apparatus can include a tank coupled with the post at a distal end of the post opposite the base. The pad can extend from the base to the tank.

23 Claims, 17 Drawing Sheets

(56) References Cited

U.S. PATENT DOCUMENTS

| | | | | |
|---|---|---|---|---|
| 9,517,398 | B2 | 12/2016 | Fu et al. | |
| 9,579,554 | B1 | 2/2017 | Madden et al. | |
| 10,076,697 | B1 | 9/2018 | Publicover et al. | |
| 12,285,669 | B2 * | 4/2025 | Leavitt | A63B 69/24 |
| 2006/0019803 | A1 * | 1/2006 | Giaquinta | A63B 69/22 482/83 |
| 2007/0197351 | A1 | 8/2007 | Gonzalez | |
| 2009/0098985 | A1 | 4/2009 | Gonzalez | |
| 2013/0109541 | A1 * | 5/2013 | Fu | A63B 21/00069 482/90 |
| 2013/0267353 | A1 | 10/2013 | Hu | |
| 2013/0331235 | A1 * | 12/2013 | Fields | A63B 69/22 482/83 |
| 2014/0128226 | A1 * | 5/2014 | Chang | A63B 69/22 482/83 |
| 2014/0226919 | A1 * | 8/2014 | Fu | A63B 69/20 383/3 |
| 2018/0304138 | A1 * | 10/2018 | Conley | A63B 69/22 |
| 2019/0282880 | A1 | 9/2019 | Bortolotto | |

* cited by examiner

EXERCISE APPARATUS

CROSS-REFERENCE TO RELATED PATENT APPLICATIONS

This patent application claims priority from U.S. Provisional Application No. 63/300,784, filed Jan. 19, 2022, which is incorporated herein by reference in its entirety.

BACKGROUND

The present disclosure relates generally to a free standing punching bag for training for boxing and martial arts. It is generally used to absorb punches, kicks, elbow strikes, and knee strikes. A free standing punching bag has advantages over a hanging bag because it does not require a secondary apparatus for mounting. The design generally consists of a weighted base with a padded vertical section. While a free standing punching bag can be a good alternative to a hanging bag, the free standing punching bag can respond differently to a user impact, providing a different feel to the user, and is generally used solely for boxing or marital arts training.

SUMMARY

The technical solution described herein can provide a dampening mechanism for an exercise apparatus (e.g., a punching bag) to dampen the effect of the forces applied to the punching bag. The dampening mechanism can cause the standing punching bag to respond more like a hanging bag. The technical solution can also provide additional functionality to the standing punching bag. For example, the disclosed solution can provide anchor points for a user to grab or for external equipment to connect with to facilitate exercises outside of the traditional boxing and martial arts.

At least one aspect is directed to an exercise apparatus. The exercise apparatus can include a base. The exercise apparatus can include a post comprising a first portion and a second portion. The base can be configured to receive the first portion of the post. The exercise apparatus can include a pad disposed around the second portion of the post. The exercise apparatus can include a tank coupled with the post at a distal end of the post opposite the base. The pad can extend from the base to the tank.

At least one aspect is directed to a method. The method can include inserting a first portion of a post into a base. The method can include disposing a pad around a second portion of the post. The method can include coupling a tank with the post. The tank can be disposed at a distal end of the post opposite the base and the pad can extend from the base to the tank.

These and other aspects and implementations are discussed in detail below. The foregoing information and the following detailed description include illustrative examples of various aspects and implementations, and provide an overview or framework for understanding the nature and character of the claimed aspects and implementations. The figures provide illustration and a further understanding of the various aspects and implementations, and are incorporated in and constitute part of the specification. The foregoing information and the following detailed description and figures include illustrative examples and should not be considered as limiting.

BRIEF DESCRIPTION OF THE FIGURES

The accompanying figures are not intended to be drawn to scale. Like reference numbers and designations in the various figures indicate like elements. For purposes of clarity, not every component may be labeled in every figures. In the figures.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

The present disclosure is directed to a free standing punching bag for exercise and training (e.g., training for boxing and martial arts). The disclosed solutions can have a technical advantage of adjusting a resistance provided by the punching bag. For example, the punching bag can include an elastic diaphragm to facilitate adjustment of a resistance of the punching bag. Plates or other mechanical components can be added to or adjacent to the diaphragm to selectively increase or decrease the resistance. The disclosed solutions can also have the technical advantage of providing a dampening mechanism to absorb shock loads. For example, the punching bag can include a slosh tank. The slosh tank can be tuned with various fillers (e.g., liquids, sand, gels, etc.) and fill levels. The slosh tank can absorb strikes and improve overall stability of the apparatus without increasing the weight of a base of the apparatus. The disclosed solutions can also have the technical advantage of providing additional grip features to facilitate other forms of exercise and training. For example, the base of the punching bag can provide handles for a user to hold, to be anchor points for various exercise bands, straps, or battle ropes, etc., or be connection points for other accessories.

Figure 1:
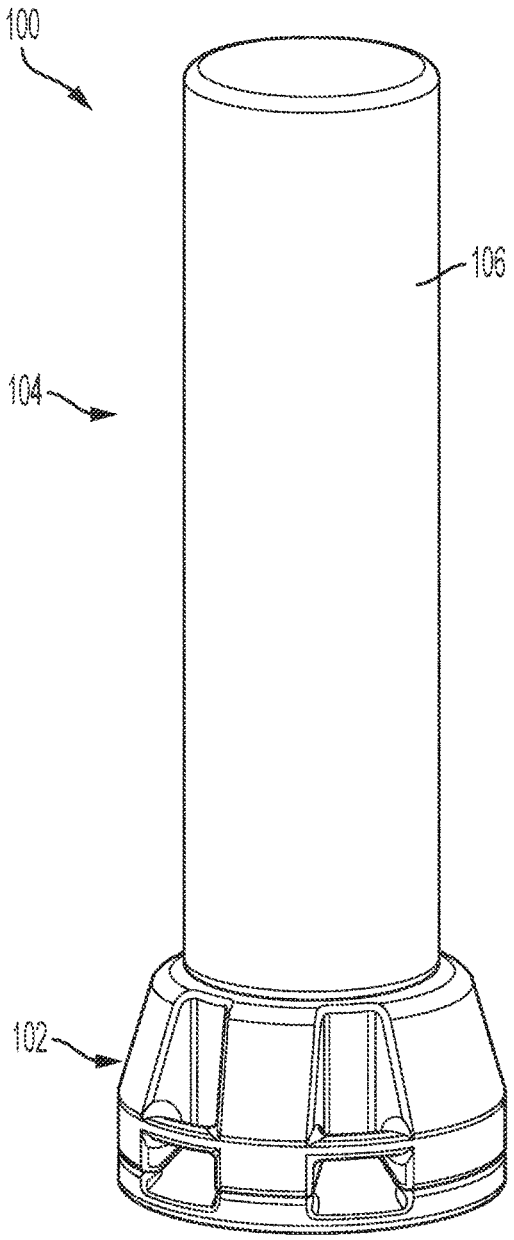
FIG. 1 is a front perspective view of an exercise apparatus, according to an exemplary embodiment.

Referring to FIG. 1, an exercise apparatus 100 is shown, according to an exemplary embodiment. The exercise apparatus 100 can be a free standing punching bag. The exercise apparatus 100 can include a base assembly 102. The base assembly 102 can provide support and stability to the exercise apparatus 100. The base assembly 102 can provide handles or attachment points to facilitate various types of exercises. The exercise apparatus 100 can include an impact assembly 104. The impact assembly 104 can be configured to receive various forces (e.g., strikes from a user). In some embodiments, the exercise apparatus 100 can include a cover 106. The cover 106 can be structured to cover the various components, or portions of the components, of the impact assembly 104.

Figure 2:
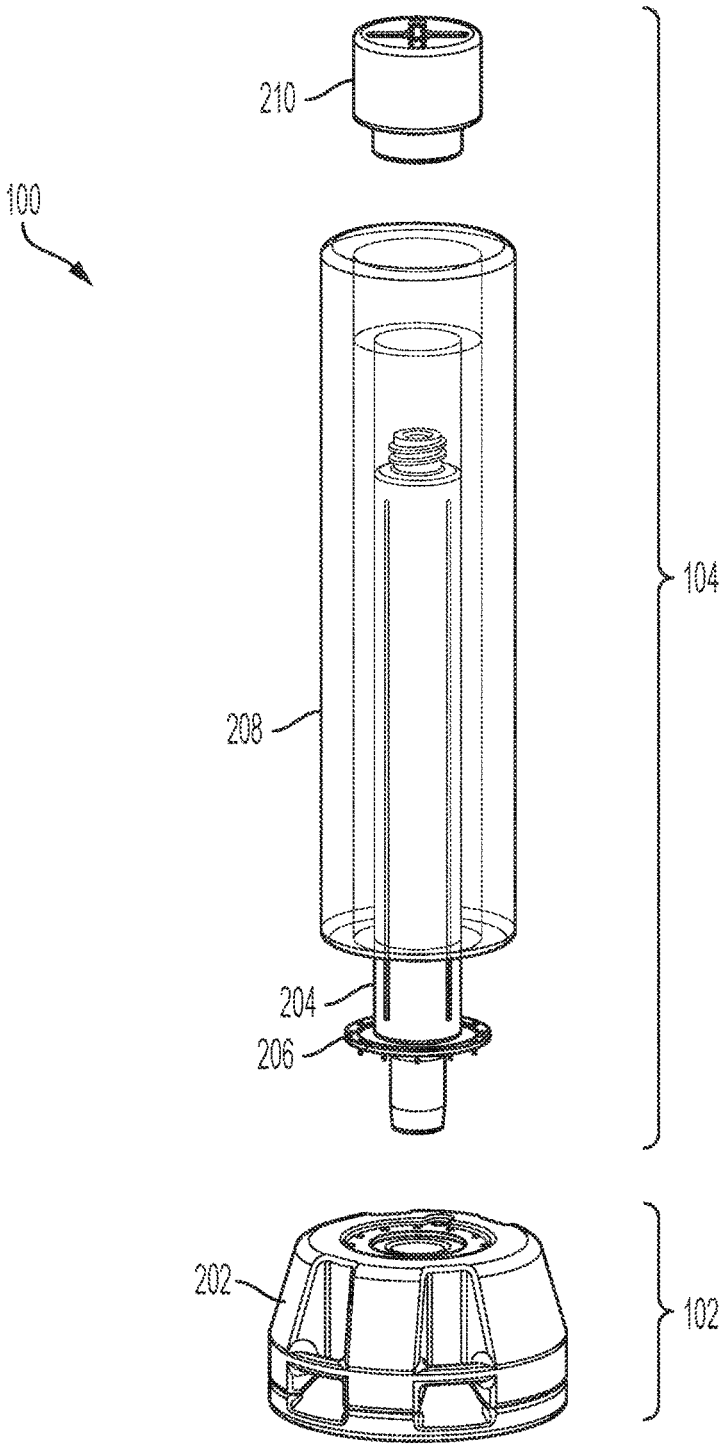
FIG. 2 is an exploded, and partially transparent view, of the exercise apparatus of FIG. 1.

Referring to FIG. 2, the base assembly 102 can include a base 202. The base 202 can be the bottom most portion of the exercise apparatus 100. For example, the base 202 can be disposed on a ground or floor, or on an intervening surface (e.g., an exercise mat). The base 202 can provide support and stability to the exercise apparatus 100. The base assembly 102 can include other components of the exercise apparatus 100 that are disposed in the base 202. The impact assembly 104 can include a post 204. The post 204 can be coupled with the base 202 and extend away from the base 202. For example, the post 204 can extend vertically away from the base 202. The post 204 can be coupled with the base 202 via a diaphragm 206. For example, the diaphragm 206 can couple with both the post 204 and the base 202. The diaphragm 206 can be a flexible diaphragm. For example, the diaphragm 206 can be made of a rubberized material that provides some flexibility while being able to maintain a connection between the diaphragm 206, the post 204, and the base 202. The diaphragm 206 can provide a resistance to the exercise apparatus 100. The resistance can be tuned or adjusted. For example, the connections between the diaphragm 206 and the base 202 and/or the diaphragm 206 and the post 204 can be tightened or loosened to adjust the resistance. In some embodiments, additional components (e.g., plates, shims, etc.) can be added to or preloaded to the diaphragm to increase the resistance.

The impact assembly 104 can include a pad or padding 208. The terms "pad" and "padding" can be used interchangeably herein. The pad 208 can include, for example, foam, one or more pads, cushioning, or any other material, item, or device that can create a soft (e.g., flexible, deformable) impact surface. The pad 208 can be placed over or around the post 204. The pad 208 can provide a soft surface for various strikes (punches, kicks, elbows). The pad 208 can be made of various soft materials including, for example, foam. In some embodiments, the pad 208 can consist of a tank (e.g., a reservoir) or a plurality of tanks made from a soft rubberized material. The tanks can be filled with a filler (e.g., air, water, or aqueous gel) to provide various levels of firmness and stability. The tanks can be partially filled with a viscous filler (e.g., water) to provide a dampening effect from the strikes.

The impact assembly 104 can include at least one tank (e.g., container, reservoir, etc.), shown as dampening tank 210. The dampening tank 210 can be a slosh tank. The dampening tank 210 can be a dampening mechanism to absorb shock loads from strikes delivered to the pad 208. Absorbing the load can reduce the likelihood of the exercise apparatus 100 tipping and can cause the exercise apparatus 100 to respond to the load in a desired way. For example, absorbing the load can cause a free-standing punching bag to react more like a hanging punching bag and return to its initial position. The ability of the dampening tank 210 to absorb the load can be tuned with various fillers and fill levels. The dampening tank 210 can work with the diaphragm 206 to absorb the loads and improve the stability of the exercise apparatus 100 without increasing a weight of the base 202.

Referring to FIGS. 3-7, the base 202 can include a first portion, shown as top base portion 302. The base 202 can include a second portion, shown as bottom base portion 304. The top base portion 302 can be coupled with the bottom base portion 304. For example, the top base portion 302 can be coupled with the bottom base portion 304 via a mechanical fastener (e.g., screw, nail, clamp, etc.). The top base portion 302 can be removably coupled with the bottom base portion 304. For example, once coupled, the top base portion 302 can be removed from or decoupled from the bottom base portion 304 without breaking the coupling mechanism or the base 202.

In some embodiments, the top base portion 302 can interface with the bottom base portion 304 without being coupled with the bottom base portion 304. For example, the top base portion 302 can sit on top of the bottom base portion 304. In some embodiments, the top base portion 302 can only be rotatably coupled with the bottom base portion 304. For example, the base 202 can include at least one locating feature 306. The locating feature 306 can include, for example, a recess and a corresponding projection that fits within the recess. The locating feature 306 can assist in assembling the base 202 by ensuring the top base portion 302 is aligned properly with the bottom base portion 304. The locating feature 306 can prevent the top base portion 302 from rotating relative to the bottom base portion 304.

Figure 3:
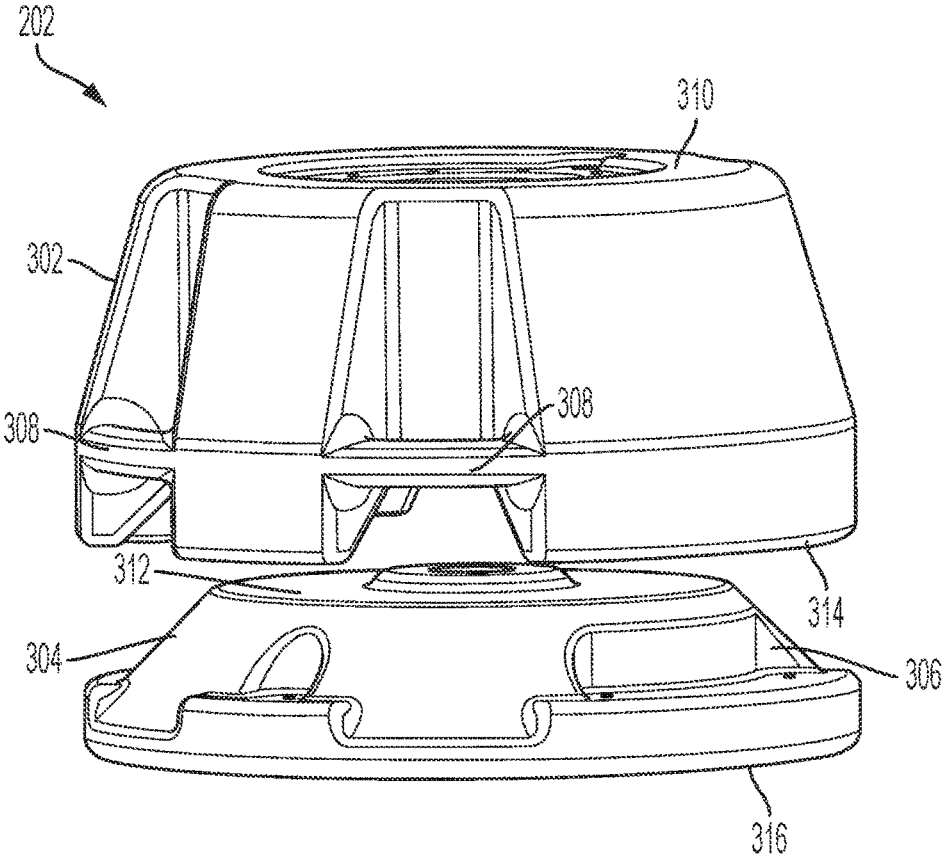
FIG. 3 is an exploded view of a base, according to an exemplary embodiment.

The base 202 can include at least one anchor point 308. The anchor point 308 can be a feature that a user can hold on to or a feature to which an external component can connect to facilitate additional exercises. For example, the anchor point 308 can be used as a foot hold and/or hand hold for various core exercises (e.g., crunches, leg raises, etc.). The anchor point 308 can be an attachment point for various exercise equipment including bands, straps, battle ropes, benches, or other accessories and equipment. The anchor point 308 can have any shape or design configured to connect with an external component or be held or griped by a user. For example, as shown in FIG. 3, among others, the anchor point 308 can be a handle. A user can grab the handle or a band can be looped around the handle, for example.

Figure 4:
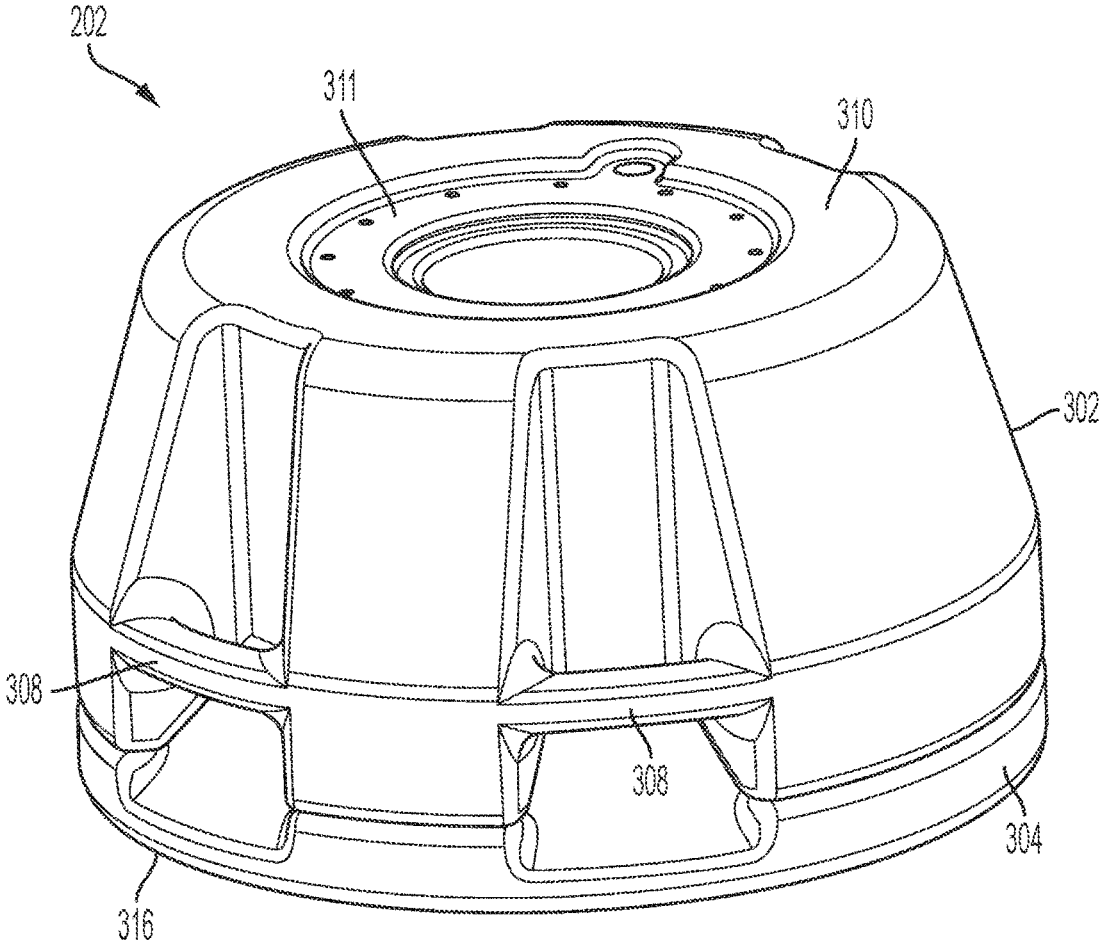
FIG. 4 is a perspective view of the base of FIG. 3.
Figure 5:
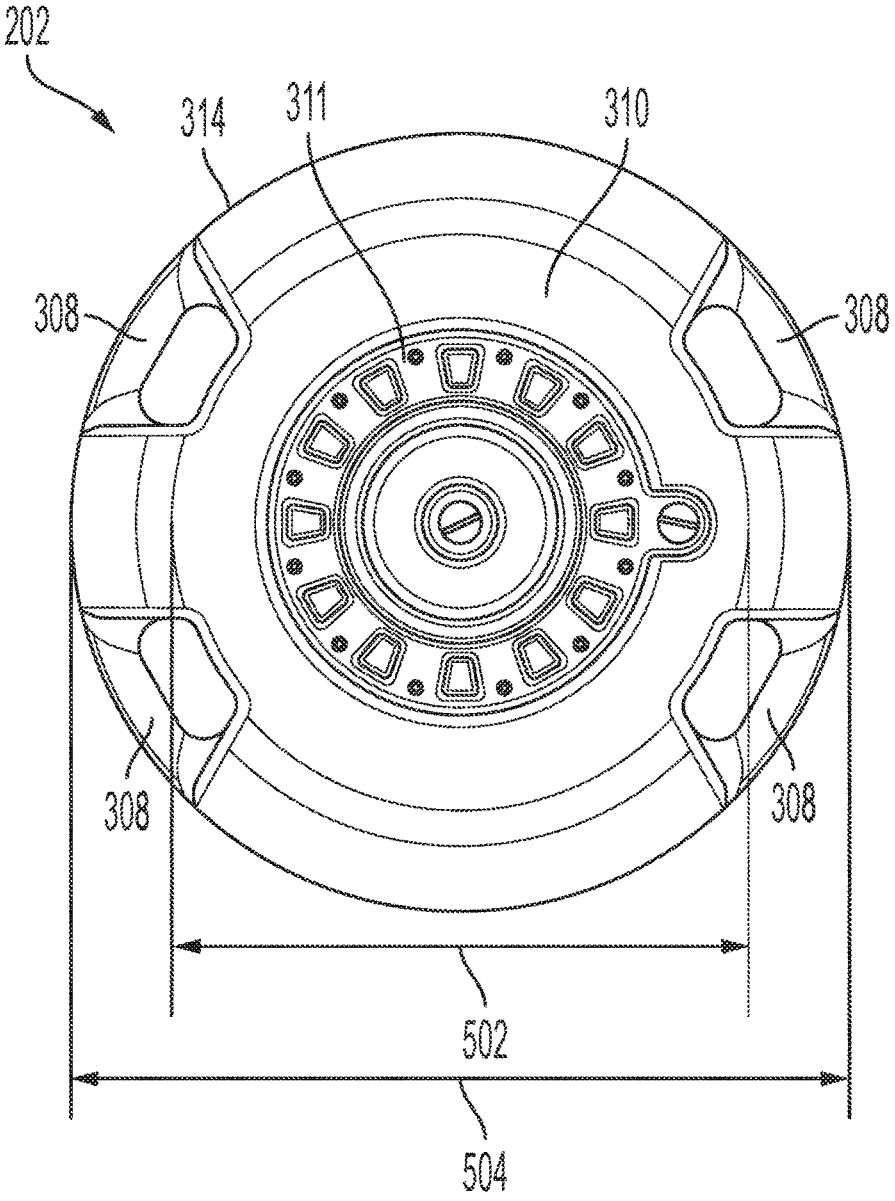
FIG. 5 is a top view of the base of FIG. 3.
Figure 6:
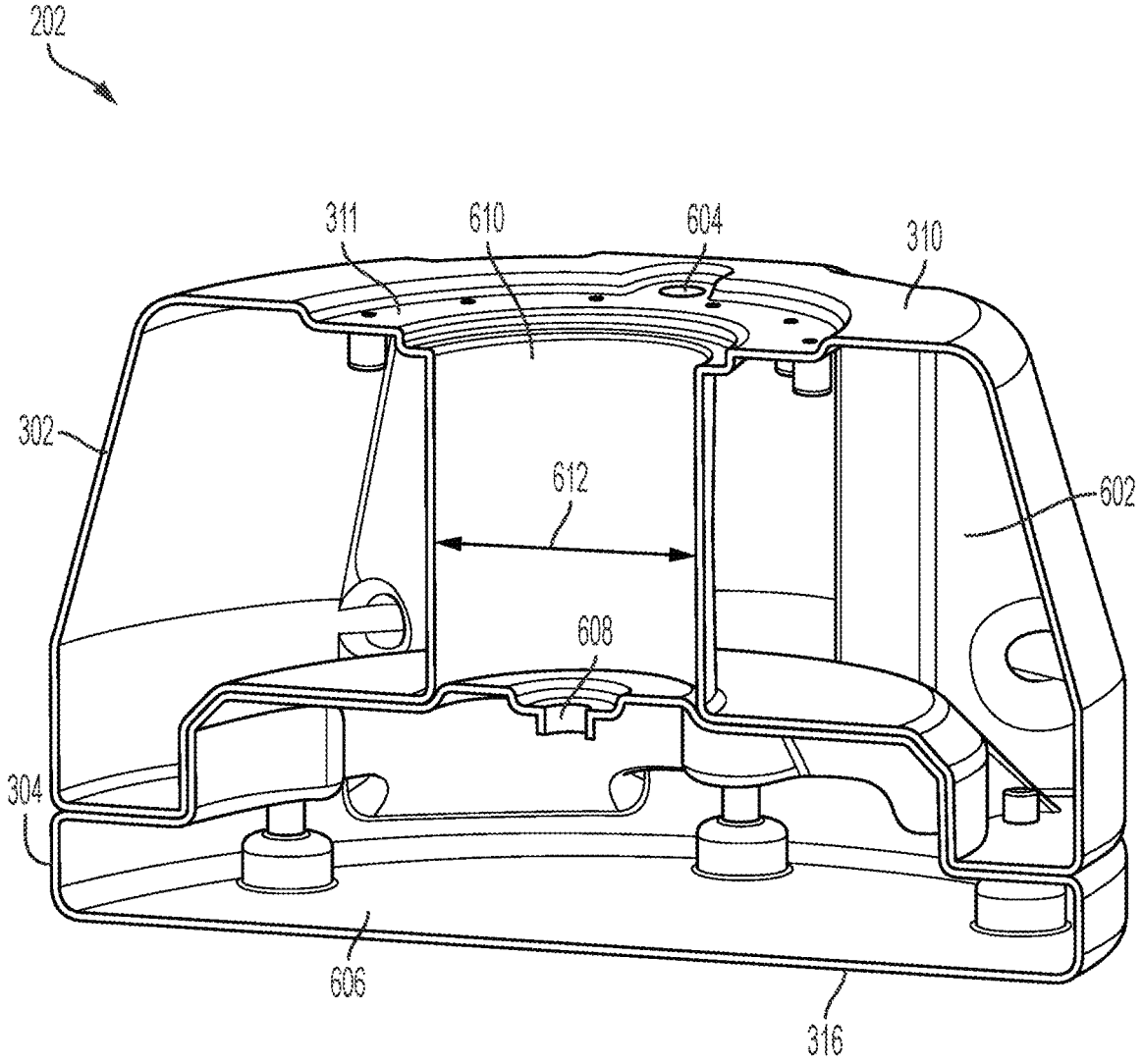
FIG. 6 is a cross-sectional view of the base of FIG. 3.

The base assembly 102 can include a plurality of anchor points 308. For example, as shown in FIG. 4, among others, the base assembly 102 can include a pair of anchor points 308. For example, a user can grab a first anchor point 308 of the pair with a right hand and grab a second anchor point 308 of the pair with a left hand. The base assembly 102 can include a plurality of pairs of anchor points 308. For example, the base assembly 102 can have a first pair disposed on a first side of the base assembly 102 and a second pair disposed on a second side of the base assembly 102. The second side can be opposite the first side. The base assembly 102 can include any number of anchor points 308. For example, a plurality of anchor points 308 can be disposed around the base assembly 102. The anchor points 308 can be equally spaced apart.

The anchor point 308 can be coupled with or integral with at least one of the top base portion 302 or the bottom base portion 304. For example, in some embodiments, the anchor point 308 can be integral with the top base portion 302. In some embodiments, the anchor point 308 can be integral with the bottom base portion 304.

The base 202 can have at least one top surface. For example, the top base portion 302 can have a first top surface 310. The first top surface 310 can be round. In some embodiments, the first top surface 310 can define or include a recess 311. As described in more detail below, the recess 311 can be configured to receive the diaphragm 206 and couple the post 204 with the base 202. In some embodiments, the first top surface 310 can be a flat surface, and the diaphragm 206 can be disposed on the first top surface 310. The bottom base portion 304 can have a second top surface 312. The second top surface 312 can be round. The base 202 can have at least one bottom surface. For example, the top base portion 302 can have a first bottom surface 314. The first bottom surface 314 can be round. The bottom base portion 304 can have a second bottom surface 316. The second bottom surface 316 can be round. The first and/or second bottom surface 314, 316 can comprise a round shape. The first and/or second bottom surface 314, 316 can have no interruptions. For example, a round, uninterrupted first and/or second bottom surface 314, 316 can facilitate easy movement of the exercise apparatus 100 by tipping and rolling the exercise apparatus 100 on the edge of the first and/or second bottom surface 314, 316.

The base 202 can have at least a partial (e.g., truncated) conical shape. The partial conical shape can provide additional clearance at the top of the base 202 (e.g., at first top surface 310) for low kicks while allowing for an increased diameter at the bottom of the base 202 for stability (e.g., at second bottom surface 316). For example, the first top surface 310 can have a round shape with a first diameter, shown as top diameter 502. The first bottom surface 314 can have a round shape with a second diameter shown as bottom diameter 504. The top diameter 512 can be less than the bottom diameter 514. The first bottom surface 314 and the second bottom surface 316 can have the same diameter (e.g., the bottom diameter 514).

The base assembly 102 can include at least one base reservoir. For example, the top base portion 302 can include at least one top base reservoir 602. The top base reservoir 602 can be configured to create a weighted base 202 for the exercise apparatus 100. For example, the top base reservoir 602 can be at least partially filled with a filler (e.g., water, aqueous gel, sand, steel shot, etc.) to achieve a desired weight to stabilize the exercise apparatus 100. The top base portion 302 can include a single, continuous top base reservoir 602. In some embodiments, the top base portion 302 can include a plurality of independent top base reservoirs 602. The top base reservoir 602 can receive the filler via a top base inlet 604. The top base inlet 604 can be disposed on the first top surface 310 of the top base portion 302. The top base inlet 604 can be disposed in the recess 311 of the first top surface 310. The top base inlet 604 can be disposed such that filler can be added to or removed from the top base reservoir 602 with the diaphragm 206 disposed in the recess 311. For example, the top base inlet 604 can be disposed radially outward from the diaphragm 206 (e.g., radially outward from the recess 311)

In some embodiments, the bottom base portion 304 can include at least one bottom base reservoir 606. The bottom base reservoir 606 can be configured to create a weighted base 202 for the exercise apparatus 100. For example, the bottom base reservoir 606 can be at least partially filled with a filler (e.g., water, aqueous gel, sand, steel shot, etc.) to achieve a desired weight to stabilize the exercise apparatus 100. The bottom base portion 304 can include a single, continuous bottom base reservoir 606. In some embodiments, the bottom base portion 304 can include a plurality of independent bottom base reservoirs 606. The bottom base reservoir 606 can receive the filler via a bottom base inlet 608. The bottom base inlet 608 can be disposed on the second top surface 312 of the bottom base portion 304. The bottom base inlet 608 can be disposed centrally on the second top surface 312.

The top base portion 302 defines a receptacle 610. The receptacle 610 can extend from the first top surface 310 to first bottom surface 314. The receptacle 610 can be disposed centrally within the top base portion 302. The receptacle 610 can be centrally aligned with the bottom base inlet 608 of the bottom base portion 304. The receptacle 610 can be configured to receive a portion of the post 204. For example, the receptacle 610 can have a receptacle diameter 612. As described in more detail herein, the receptacle diameter 612 can be sized based on a size of the post 204 and/or a desired angle of deflection.

Figure 7:
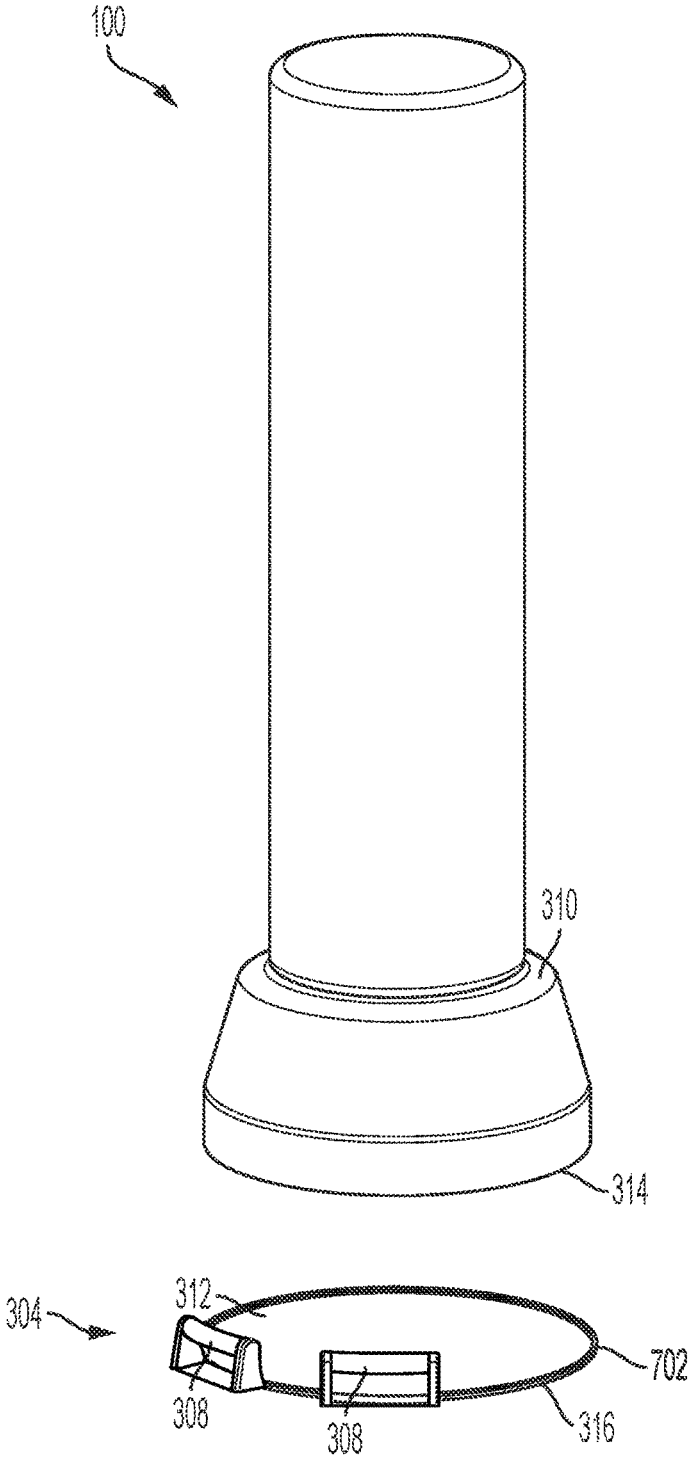
FIG. 7 is a front perspective, and partially exploded view of an exercise apparatus, according to an exemplary embodiment.

As shown in FIG. 7, in some embodiments, the bottom base portion 304 can have a flat shape. For example, the bottom base portion 304 can be have a disk shape. The bottom base portion 304 can include no bottom base reservoir 606. The bottom base portion 304 can have a perimeter 702. At least one anchor point 308 can extend from the perimeter 702. The first bottom surface 314 of the top base portion 302 can interface with the second top surface 312 of the bottom base portion 304. The top base portion can keep the bottom base portion 304 stationary relative to the top base portion 302.

Figure 8:
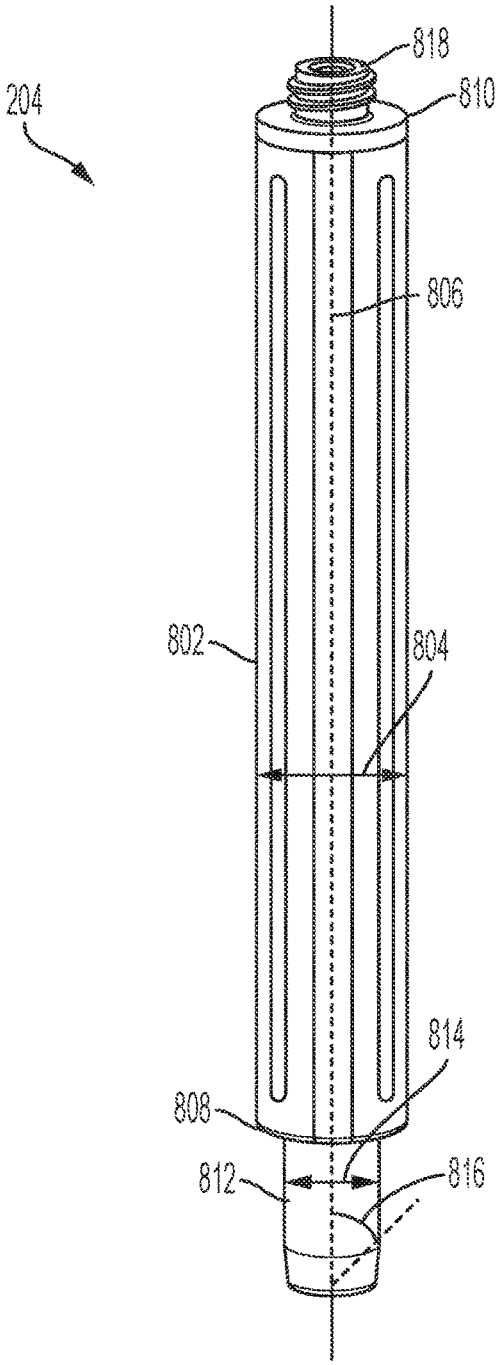
FIG. 8 is a front view of a post, according to an exemplary embodiment.
Figure 9:
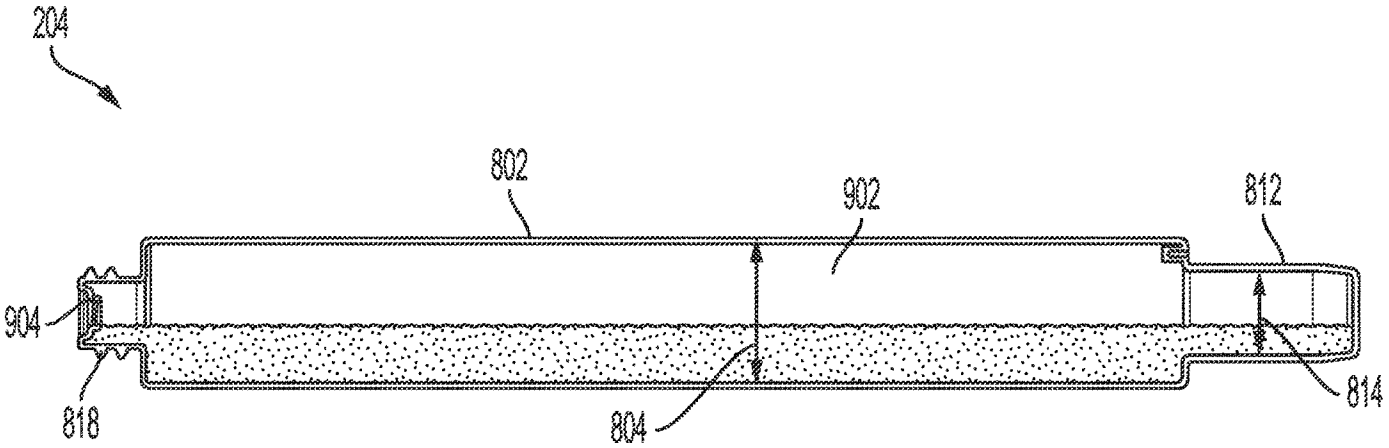
FIG. 9 is a cross sectional view of the post of FIG. 8.

Referring to FIGS. 8 and 9, the exercise apparatus 100 can include the post 204. The post 204 can include a first portion, shown as post body 802. The post body 802 can be a part of the impact assembly 104. The post body 802 can provide structural support for various components of the exercise apparatus 100. For example, the post body 802 can provide support for the pad 208 and the dampening tank 210. The post body 802 can be an elongated member. For example, a length or height of the post body 802 can be greater than a width or diameter of the post body 802. The post body 802 can be any shape. For example, the post body 802 can have a cylindrical shape. The post body 802 can have a first diameter, shown as body diameter 804. In some embodiments, the body diameter 804 can be a width of the post body 802 if the post body 802 is a different shape (e.g., a rectangular box).

The post 204 can define a central axis 806. For example, the central axis 806 can extend longitudinally along the post 204. The post body 802 can be centered on the central axis 806. The central axis 806 can extend from a first end 808 (e.g., bottom end) of the post body 802 to a second end 810 (e.g., top end) of the post body 802.

The post 204 can include a second portion, shown as post anchor 812. The post anchor 812 can engage with the base 202. For example, at least a portion of the post anchor 812 can be disposed in the receptacle 610 of the base 202. As described in more detail herein, the post anchor 812 can limit angular movement of the post 204. Limiting the angular movement of the post 204 can assist in stabilizing the exercise apparatus 100 and improve overall durability of the diaphragm 206. The post anchor 812 can extend from the first end 808 of the post body 802. The post anchor 812 can be axially aligned with the post body 802. For example, the post anchor 812 can be centered on the central axis 806. The post anchor 812 can have any shape. For example, the post anchor 812 can have a cylindrical shape. The post anchor 812 can have the same or different shape than the post body 802. The post anchor 812 can have a second diameter, shown as anchor diameter 814. The anchor diameter 814 can be smaller than the body diameter 804. In some embodiments, the anchor diameter 814 can be a width of the post anchor 812 if the post anchor 812 is a different shape (e.g., a rectangular box).

The anchor diameter 814 can be based, at least partially, on the receptacle diameter 612 of the base 202. For example, the base 202 can be configured to receive the post anchor 812 via the receptacle 610. The post anchor 812 can have an anchor diameter 814 that is smaller than the receptacle diameter 612 to fit inside the receptacle 610. The anchor diameter 814 can be based, at least partially, on a predetermined angle of deflection 816. For example, with the post anchor 812 disposed in the receptacle 610, the post 204 can be configured to deflect or lean a predetermined angle (e.g., the angle of deflection 816) from a neutral position. The angle of deflection 816 can be a deviation from the neutral position. For example, the neutral position of the post 204 (and therefore the central axis 806) can be vertical. The angle of deflection 816 can define the degrees from which the central axis 806 can deflect from the neutral (e.g., vertical) position. The anchor diameter 814 can be configured to facilitate the predetermined angle of deflection 816. For example, the angle of deflection 816 can range between 0 and 45 degrees from the neutral position. For example, the angle of deflection 816 can range between 2 and 10 degrees, or between 5 and 10 degrees, from the neutral position of the post 204 (e.g., 6 degrees). In some embodiments, the post 204 can be coupled with the base 202 such that there is no (or minimal) angle of deflection 816 (e.g., <1 degree). As described in more detail herein, the angle of deflection 816 can be adjustable.

The angle of deflection 816 can determine a reaction of the exercise apparatus 100 to a force applied to the impact assembly 104. For example, a smaller angle of deflection 816 can provide a more rigid, more responsive (e.g., returns to original position quicker) exercise apparatus 100, while a larger angle of deflection 816 can provide a less rigid, less responsive exercise apparatus 100. Limiting the angle of deflection 816 can stabilize the exercise apparatus 100. For example, limiting the angle of deflection 816 can prevent the center of mass of the exercise apparatus 100 from traveling too close to, or beyond an outer edge of the base 202. Limiting the angle of deflection 816 can increase durability of the diaphragm 206. For example, limiting the angle of deflection 816 can reduce the deflection of the diaphragm 206. Limiting the angle of deflection 816 can make it easier to move the exercise apparatus 100 to a different location. For example, limiting the angle of deflection 816 can set the center of mass at a position that, when the padding 208 on the exercise apparatus 100 is tipped (e.g., at an angle of 10-20 degrees from vertical), the base 202 can also tip to a similar angle such that the exercise apparatus 100 can be rolled on a bottom edge of the base 202. As described in more detail herein, the position of the dampening tank 210 and the volume and viscosity of the filler in the dampening tank 210 can also facilitate easier movement of the exercise apparatus 100 to a different location.

The post 204 can include a third portion, shown as post connector 818. The post connector 818 can be opposite the post anchor 812. For example, the post connector 818 can be disposed at the second end 810 (e.g., top end) of the post body 802. In some embodiments, the post connector 818 can extend from the second end 810 of the post body 802. The post connector 818 can couple the post 204 with at least one other component of the exercise apparatus 100. For example, the post connector 818 can couple the dampening tank 210 with the post 204. In some embodiments, the post connector 818 can be threaded. The post connector 818 can be axially aligned with the post body 802. For example, the post connector 818 can be centered on the central axis 806.

The post 204 can define at least one reservoir, shown as post reservoir 902. The post reservoir 902 can be configured to receive a filler (e.g., water, gel, sand, etc.). The type of filler and the amount of the filler can adjust the response of the post 204 to a force applied to the post 204 (e.g., a strike from a user). The post 204 can include at least one filler inlet, shown as post inlet 904. The post inlet 904 can be the access point to fill or empty the post reservoir 902. The post inlet 904 can be disposed on the post connector 818. For example, the post inlet 904 can be disposed such that the filler can enter the post reservoir 902 via the top of the post 204. The filler can move from the second end 810 (e.g., top end) of the post body 802 to the first end 808 (e.g., bottom end).

At least one of the portions of the post 204 can define the post reservoir 902. For example, the post body 802, the post anchor 812, and the post connector 818 can each define a portion of the post reservoir 902 (e.g., the post reservoir 902 can extend from the post connector 818 to the post anchor 812). In some embodiments, a subset of the portions of the post 204 can define the post reservoir 902. For example, the post reservoir 902 can be defined by only the post body 802.

Figure 10:
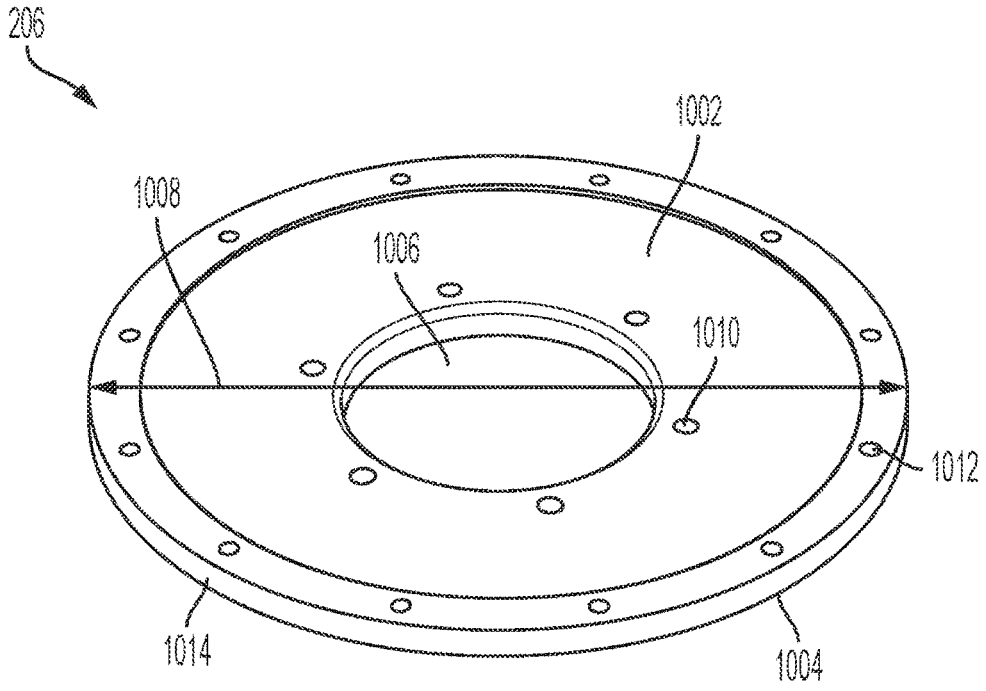
FIG. 10 is a front perspective view of a diaphragm, according to an exemplary embodiment.
Figure 11:
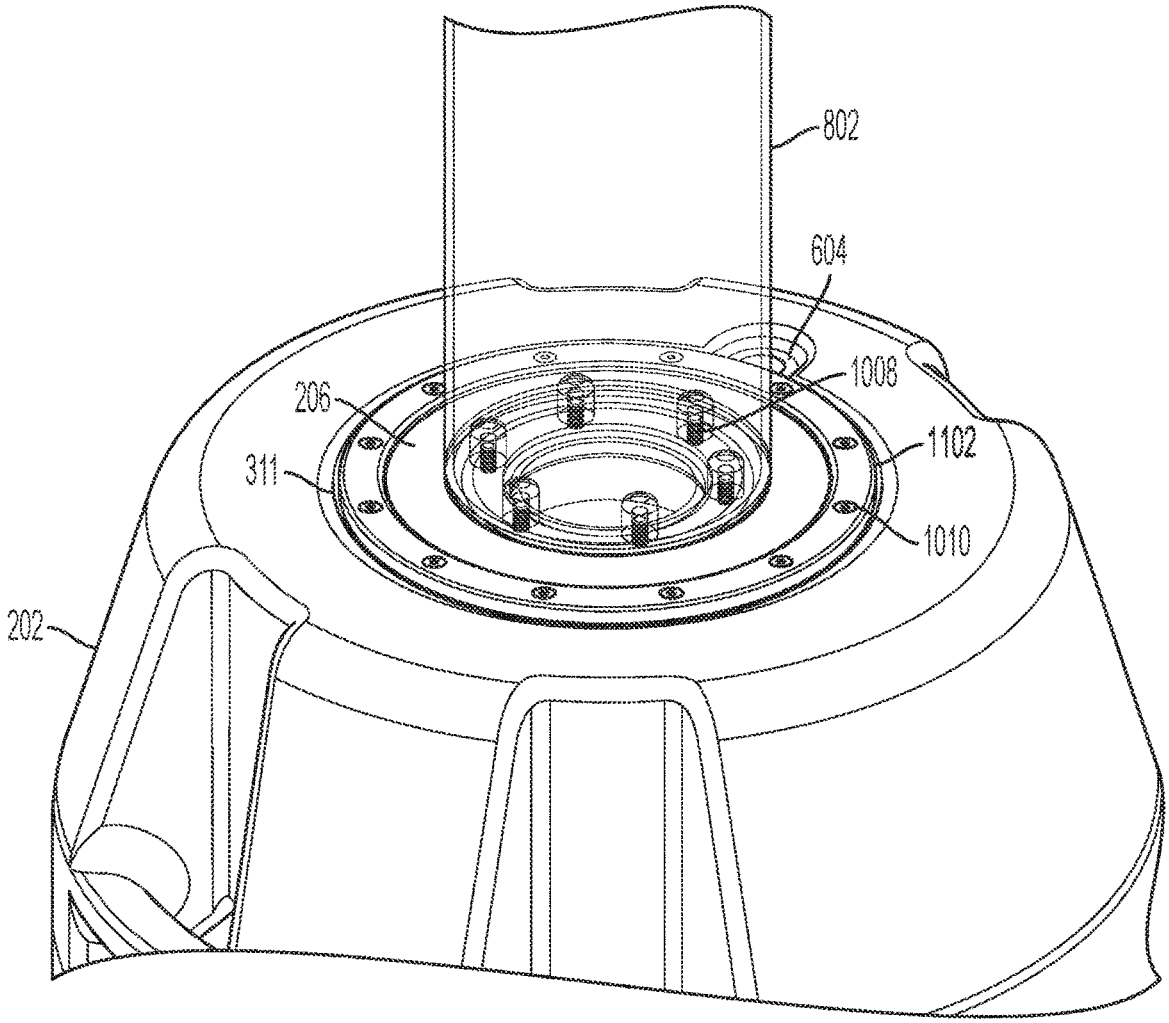
FIG. 11 is a top perspective and partially transparent view of a portion of the exercise apparatus of FIG. 1.
Figure 12:
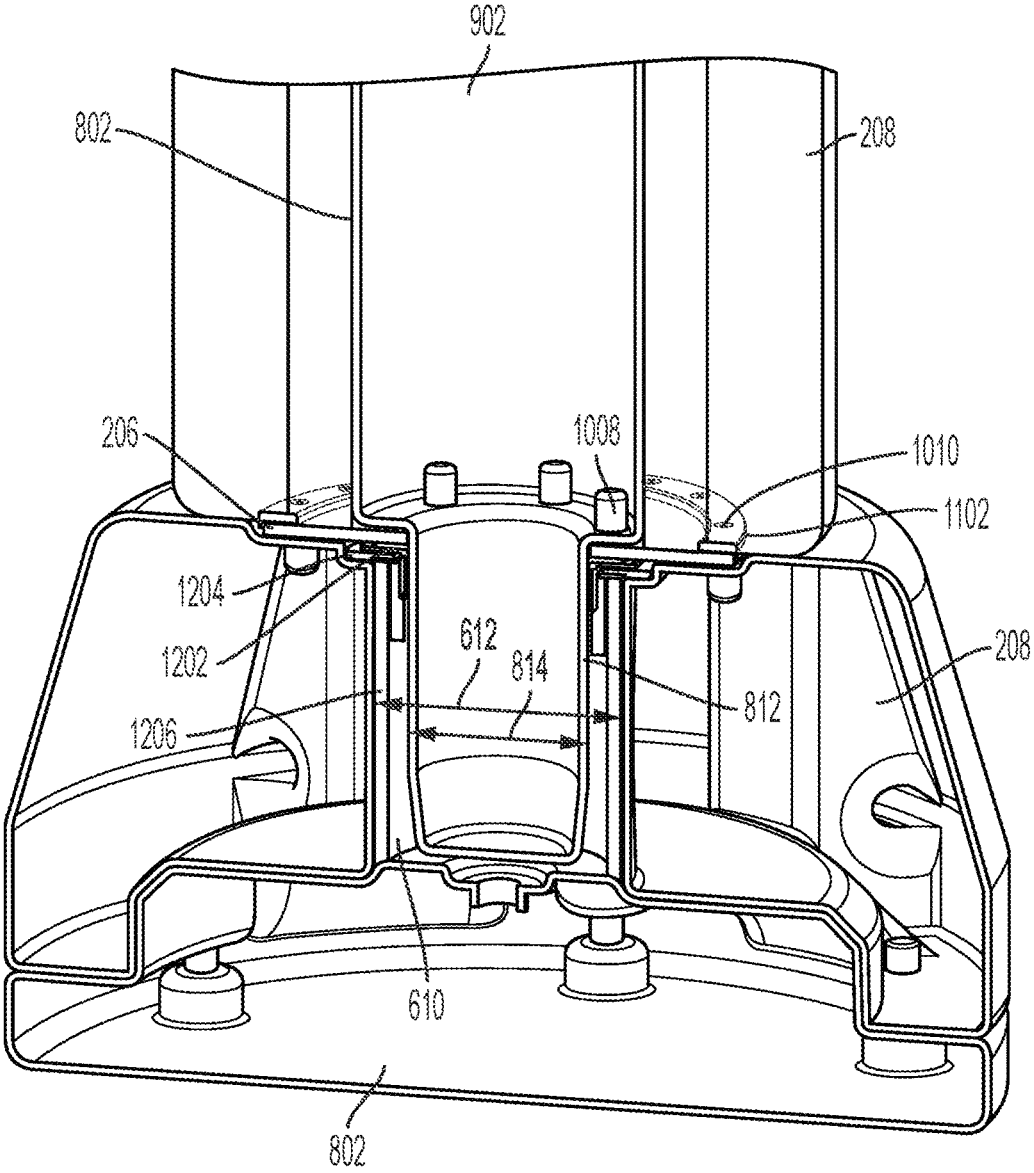
FIG. 12 is a partial transparent cross-sectional view of a portion of the exercise apparatus of FIG. 1.

Referring to FIGS. 10-12, the exercise apparatus 100 can include the diaphragm 206. The diaphragm 206 can be a flexible (e.g., elastic, deformable) diaphragm. For example, the diaphragm 206 can be made of a flexible material. For example, the diaphragm 206 can be made of a rubberized material. The diaphragm 206 can be disposed at least partially between the post 204 and the base 202. The diaphragm 206 can be configured to couple the post 204 with the base 202. The diaphragm 206 can couple the post 204 with the base 202 and still allow angular movement of the post 204 (e.g., angle of deflection 816). The diaphragm 206 can provide an initial resistance to the movement or deflection of the post 204. The diaphragm 206 can allow the post 204 to move relative to the base 202. The resistance can be tuned by using various elastic materials of various thicknesses. The resistance can be tuned by using various materials of various hardnesses. As described in more detail here, the resistance can also be tuned with the addition of stiffeners (e.g., shims, plates, etc.).

The diaphragm 206 can have a flat shape. For example, the diaphragm 206 can have a disk shape. The diaphragm 206 can have a top face 1002 and a bottom face 1004. The top face 1002 can be structured to interface with the post 204. For example, the first end 808 of the post body 802 can interface with the top face 1002 of the diaphragm 206. The diaphragm 206 can include a central opening 1006. The central opening 1006 can extend through the diaphragm 206 (e.g., extend from the top face 1002 to the bottom face 1004). The central opening 1006 can receive the post anchor 812 such that the post anchor 812 can extend through the diaphragm 206 and the first end 808 of the post body 802 can interface with the top face 1002 of the diaphragm 206. The top face 1002 can be structured to interface with the pad 208. For example, the diaphragm 206 can have a diaphragm diameter 1008. The diaphragm diameter 1008 can be greater than the body diameter 804 of the post 204. The post 204 can interface with an inner portion of the diaphragm 206. The pad 208 can interface with an outer portion of the diaphragm 206. The bottom face 1004 can be configured to interface at least partially with the base 202. For example, the diaphragm 206 can be disposed in the recess 311 of the first top surface 310 of the base 202.

The diaphragm 206 can include at least one post connection point 1010. The post 204 can couple with the diaphragm 206 at the post connection point 1010. The post connection point 1010 can be disposed proximate to the central opening 1006 of the diaphragm 206. The diaphragm 206 can include a plurality of post connection points 1010. For example, the plurality of post connection points 1010 can be disposed around the central opening 1006. The post 204 can couple with the diaphragm 206 at the post connection point 1010 via any type of coupling mechanism. For example, the post 204 can couple with the diaphragm 206 via a mechanical fastener (e.g., bolt, screw, nail, rivet, clamp, etc.), an adhesive (e.g., glue), or any other coupling mechanism.

The diaphragm 206 can include at least one base connection point 1012. The base 202 can couple with the diaphragm 206 at the base connection point 1012. The base connection point 1012 can be disposed proximate to an exterior edge 1014 of the diaphragm 206. The diaphragm 206 can include a plurality of base connection points 1012. For example, the plurality of base connection points 1012 can be disposed around the central opening 1006 and disposed radially outward from the post connection points 1010 (e.g., along the exterior edge 1014 of the diaphragm 206). The base 202 can couple with the diaphragm 206 at the base connection point 1012 via any type of couple mechanism. For example, the base 202 can couple with the diaphragm 206 via a mechanical fastener (e.g., bolt, screw, nail, rivet, clamp, etc.), an adhesive (e.g., glue), or any other coupling mechanism.

As shown in FIG. 11, among others, the exercise apparatus 100 can include at least one clamp, shown as upper diaphragm clamp 1102. The upper diaphragm clamp 1102 can provide additional rigidity to the diaphragm 206. The upper diaphragm clamp 1102 can be coupled with the diaphragm 206 via the base connection point 1012. The upper diaphragm clamp 1102 can be disposed at or proximate to the exterior edge 1014 of the diaphragm 206. One or more upper diaphragm clamps 1102 can extend along the perimeter of the diaphragm 206. The upper diaphragm clamp 1102 can be structured to assist in coupling the diaphragm 206 with the base 202.

As shown in FIG. 12, among others, the exercise apparatus 100 can include at least one clamp, shown as lower diaphragm clamp 1202. The lower diaphragm clamp 1202 can provide additional rigidity to the diaphragm 206. The lower diaphragm clamp 1202 can be coupled with the diaphragm 206 via the post connection point 1010. The lower diaphragm clamp 1202 can be disposed at or proximate to the central opening 1006 of the diaphragm 206. One or more lower diaphragm clamps 1202 can extend along the perimeter of the central opening 1006. The lower diaphragm clamp 1202 can be structured to assist in coupling the diaphragm 206 with the post 204.

The exercise apparatus 100 can include at least one stiffener, shown as plate 1204. The plate 1204 can provide additional rigidity (e.g., resistance to movement of the post 204) to the diaphragm 206. For example, the plate 1204 can be made of a rigid material (e.g., metal, plastic, etc.). The plate 1204 can reduce the amount that the diaphragm 206 flexes in response to the impact assembly 104 receiving a force. The plate 1204 can be disposed, at least partially, between the diaphragm 206 and the base 202. The exercise apparatus 100 can include a plurality of plates 1204. Additional plates can add additional rigidity to the exercise apparatus 100.

The exercise apparatus 100 can include at least one buffer 1206. The buffer 1206 can provide cushioning for the post anchor 812 and fill a space between the post anchor 812 and a wall of the receptacle 610 of the base 202. The buffer 1206 can modify the angle of deflection 816 of the post 204. For example, the buffer 1206 can be disposed in the receptacle 610. The buffer 1206 can be disposed between a wall of the receptacle 610 and the post anchor 812. Without the buffer 1206, the space between the wall of the receptacle 610 and the post anchor 812 can allow a first angle of deflection. The buffer 1206 can act as an extension of the wall of the receptacle 610 and reduce the space between the post anchor 812 and the wall. The smaller space can provide less space for the post anchor 812 to move, and reduce the angle of deflection 816 of the post 204.

Figure 13:
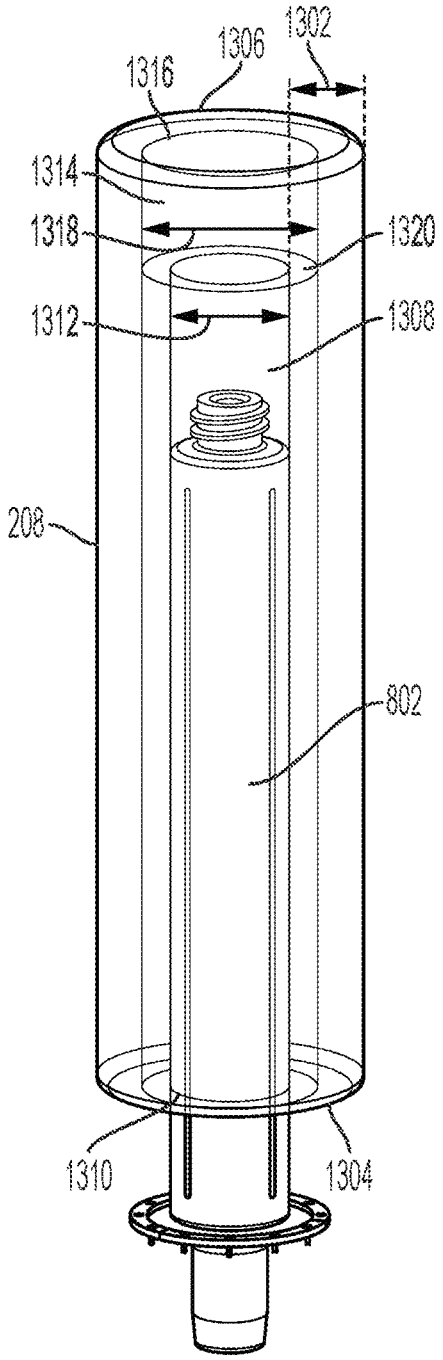
FIG. 13 is a partial exploded and partial transparent view of a portion of the exercise apparatus of FIG. 1.

Referring to FIG. 13, the exercise apparatus 100 can include padding (e.g., a pad) 208. The exercise apparatus 100 can include at least one layer of padding 208. For example, the padding 208 of the exercise apparatus 100 can have a thickness 1302. The thickness 1302 can be obtained by a single layer of padding 208, the single layer having the thickness 1302, or a plurality of layers of padding 208 that can be combined to create the thickness 1302. The plurality of layers of padding 208 can be coupled together. The padding 208 can have any shape. For example, the padding 208 can have a cylindrical shape. The padding 208 can have a first surface, shown as bottom pad surface 1304, and a second surface, shown as top pad surface 1306. At least a portion of the bottom pad surface 1304 can interface with the diaphragm 206.

The pad 208 can be disposed around at least a portion of the post 204. For example, the pad 208 can be disposed around the post body 802. The pad 208 can define a first cavity 1308. The first cavity 1308 can be configured to receive at least a portion of the post 204. The bottom pad surface 1304 of the pad 208 can define a bottom opening 1310. The post 204 can extend into the first cavity 1308 via the bottom opening 1310. In some embodiments, the post body 802 can be disposed in the first cavity 1308. In some embodiments, the post connector 818 can be disposed in the first cavity 1308. The first cavity 1308 can have a first cavity diameter 1312. The first cavity diameter 1312 can be configured such that an outer surface of the post body 802 can interface with an inner surface of the pad 208. For example, the first cavity diameter 1312 can be slightly greater than the body diameter 804 to allow the post body 802 to slide into the first cavity 1308. With the bottom pad surface 1304 interfacing the diaphragm 206, the post body 802 can be disposed in the first cavity 1308.

The pad 208 can define a second cavity 1314. The second cavity 1314 can be configured to receive at least a portion of the dampening tank 210. The top pad surface 1306 of the pad 208 can define a top opening 1316. The dampening tank 210 can enter the second cavity 1314 via the top opening 1316. As described in more detail here, the dampening tank 210 can be disposed, at least partially, in the second cavity 1314. The second cavity 1314 can have a second cavity diameter 1318. The second cavity diameter 1318 can be based, at least partially, on a size of the dampening tank 210.

The pad 208 can define a ridge 1320. The ridge 1320 can separate the first cavity 1308 from the second cavity 1314. As described in more detail herein, the dampening tank 210 can interface with the ridge 1320 to prevent movement (e.g., translational movement) of the pad 208 relative to the post 204. In some embodiments, the first cavity 1308 and the second cavity 1314 can be defined by a plurality of layers of the pad 208. For example, a first layer (e.g., inner layer) of the padding 208 can define the first cavity 1308. A second layer (e.g., outer layer) of the padding 208 can be disposed around the first layer of the padding 208 and extend beyond an end of the first layer. The portion of the second layer that extends beyond the first layer can define the second cavity 1314. The top of the first layer of the padding 208 can create the ridge 1320. The inner layer and the outer layer can include any number of layers of padding 208. In some embodiments, the first cavity 1308 and the second cavity 1314 can be defined by a single layer of padding 208. For example, the single layer of padding 208 can shaped to include the ridge 1320 (e.g., the ridge 1320 can be formed in the padding 208.

Figure 14:
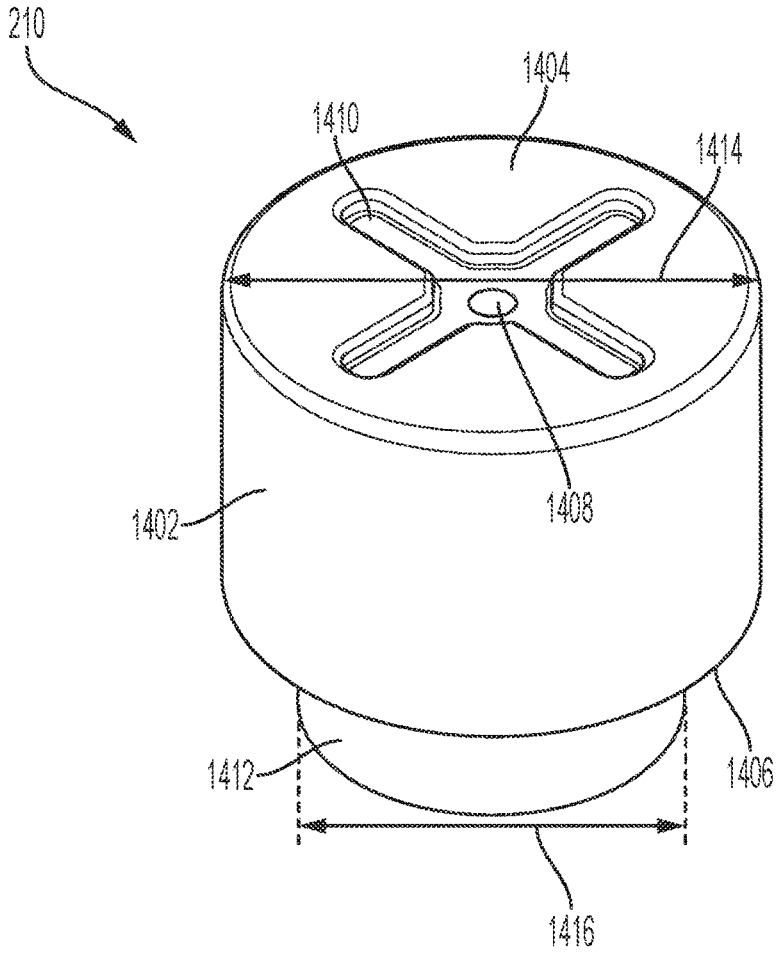
FIG. 14 is a top perspective view of a dampening tank, according to an exemplary embodiment.
Figure 15:
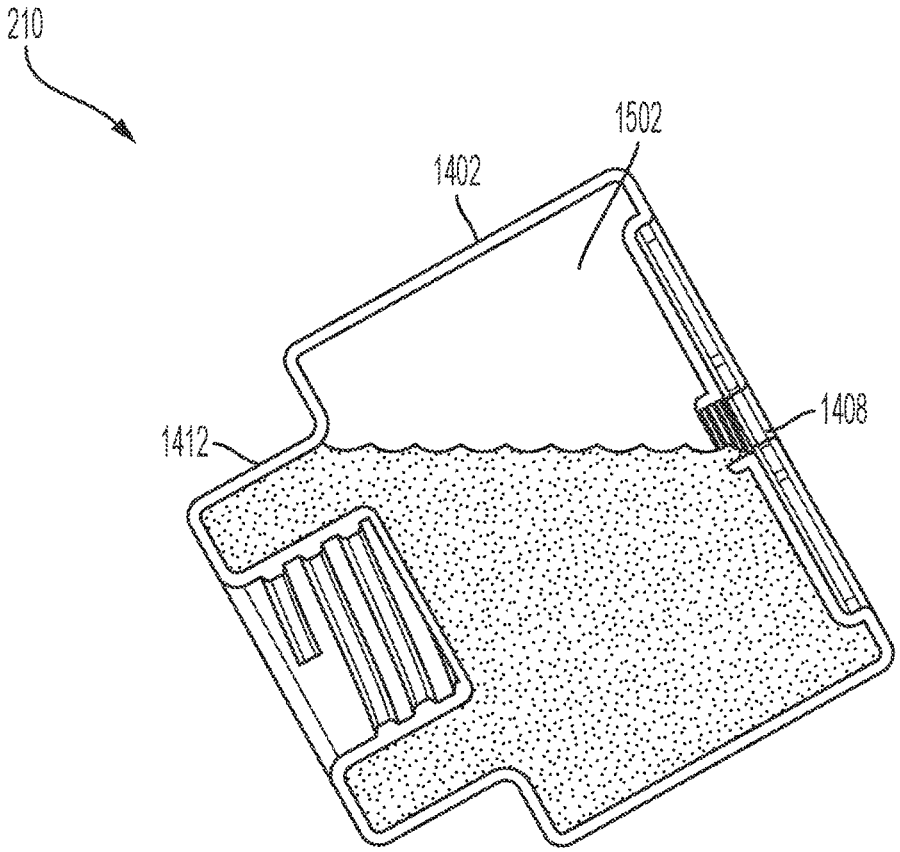
FIG. 15 is a cross-sectional view of the dampening tank of FIG. 14.
Figure 16:
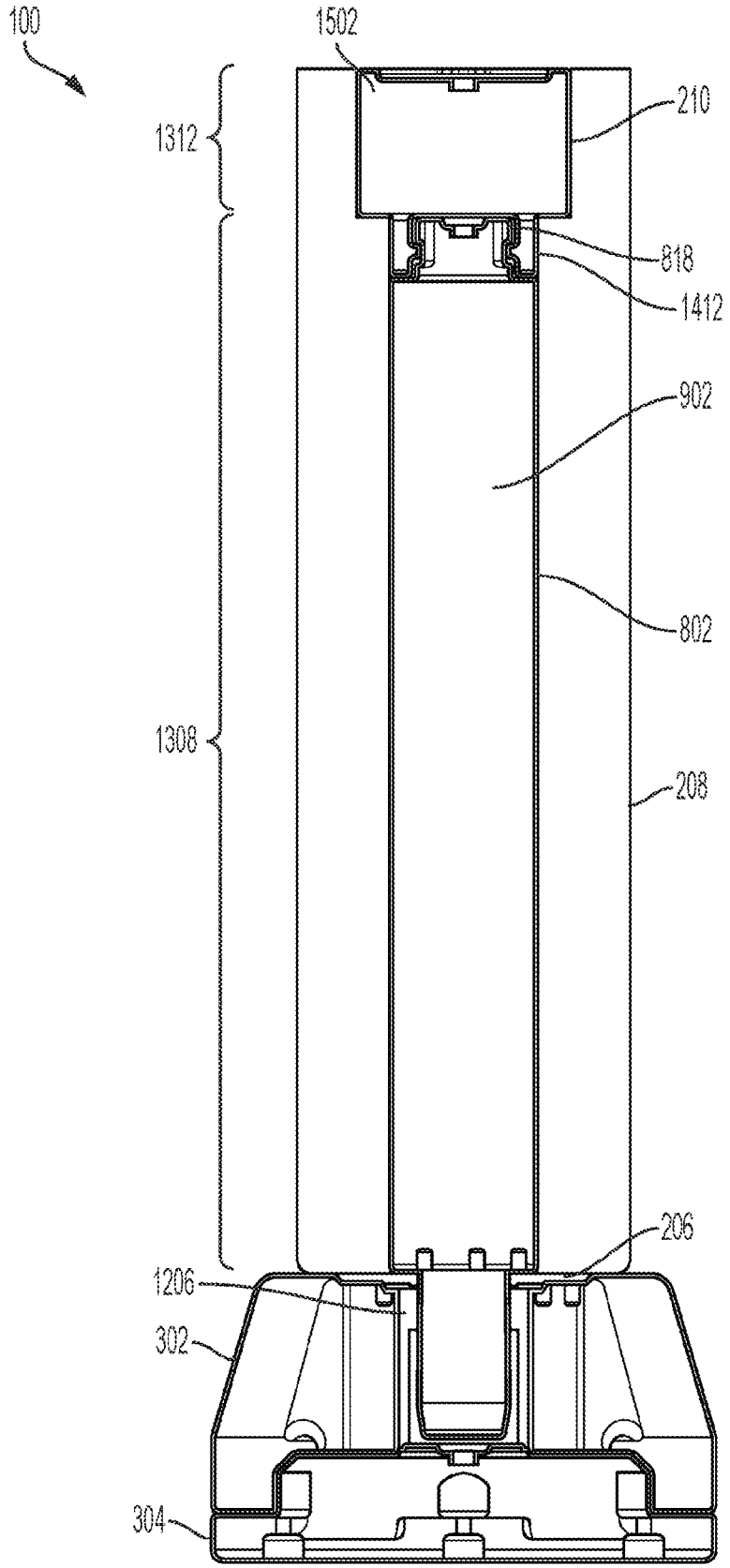
FIG. 16 is a cross-sectional view of the exercise apparatus of FIG. 1.

Referring to FIGS. 14-16, the exercise apparatus 100 can include at least one dampening tank 210. The dampening tank 210 can be structured to provide a dampening effect for the forces (e.g., strikes) that the exercise apparatus 100 receives. For example, the dampening tank 210 can be coupled with a distal end (e.g., top) of the post 204 opposite the base 202 (e.g., via the post connector 818). The padding 208 can extend from the base 202 to the dampening tank 210. The dampening tank 210 can be at least partially filled with a fluid (e.g., a viscous liquid). The force received by the exercise apparatus 100 can create a sloshing effect of the viscous liquid in the dampening tank 210 to create the dampening effect. The sloshing effect can be tuned by varying the level of the fluid in the tank and by introducing liquids of varying viscosity. The dampening tank 210 can be configured to provide better balance of the exercise apparatus 100 while moving. For example, the dampening tank 210 can increase a weight of the exercise apparatus 100 at a top of the exercise apparatus 100, which can move the center of gravity and improve the balance point when the exercise apparatus 100 is tipped on an edge of the base 202. For example, the exercise apparatus 100 can be more easily be rolled to a different location with the greater weight disposed at the top of the post 204.

The dampening tank 210 can include a tank body 1402. The tank body 1402 can have any shape. For example, the tank body 1402 can be cylindrical. The tank body 1402 can have a first surface, shown as an upper tank surface 1404. The tank body 1402 can have a second surface, shown as lower tank surface 1406. The upper tank surface 1404 can be opposite the lower tank surface 1406. The lower tank surface 1406 can interface with the ridge 3120 of the padding 208. The dampening tank 210 can include at least one opening, shown as tank inlet 1408. The tank inlet 1408 can provide a passage for the fluid to enter and exit the dampening tank 210. The tank inlet 1408 can be disposed on the upper tank surface 1404 of the dampening tank 210. The tank inlet 1408 can be disposed centrally on the upper tank surface 1404.

The tank body 1402 can include at least one grip feature 1410. The grip feature 1410 can facilitate coupling the dampening tank 210 with the post 204. For example, the grip feature 1410 can be an indent into or a projection from the upper tank surface 1404 that a person, tool, or machine can grip and use to control positioning of the dampening tank 210 to couple the dampening tank 210 with the post 204.

The dampening tank 210 can include at least one tank connector 1412. The tank connector 1412 can couple the dampening tank 210 with at least one other component of the exercise apparatus 100. For example, the tank connector 1412 can couple the dampening tank 210 with the post 204. The tank connector 1412 can be structured to interact with the post connector 818 to couple the dampening tank 210 with the post 204. For example, in some embodiments, the tank connector 1412 and the post connector 818 can be threaded. In some embodiments, the tank connector 1412 can extend from the lower tank surface 1406 of the dampening tank 210.

The tank body 1402 can have a first diameter, shown as tank diameter 1414. The tank connector 1412 can have a second diameter, shown as connector diameter 1416. The tank diameter 1414 can be greater than the connector diameter 1416. The tank diameter 1414 can be greater than the body diameter 804 of the post 204. The smaller body diameter 804 allows for there to be more padding 208 around the post 204 where a user is to strike the exercise apparatus 100 to provide more cushioning for the user. The larger tank diameter 1414 also allows for more filler to be added to the dampening tank 210 to facilitate adjusting of the dampening effect of the dampening tank 210.

The dampening tank 210 can define at least one reservoir, shown as tank reservoir 1502. The tank reservoir 1502 can be configured to receive a filler (e.g., water, gel, sand, etc.). The filler can dampen the effect of a force (e.g., a strike from a user) applied to the exercise apparatus 100. The type of filler and the amount of the filler can adjust the response of the exercise apparatus 100 to the force applied. For example, the tank reservoir 1502 can be at least partially filled with a viscous liquid. A more viscous liquid can create a quicker reaction. The tank reservoir 1502 can receive the filler via the tank inlet 1408.

At least one portion of the dampening tank 210 can define the tank reservoir 1502. For example, the tank body 1402 and the tank connector 1412 can each define a portion of the tank reservoir 1502 (e.g., the tank reservoir 1502 can extend from the tank body 1402 to the tank connector 1412). In some embodiments, a subset of the portions of the dampening tank 210 can define the tank reservoir 1502. For example, the tank reservoir 1502 can be defined by only the tank body 1402.

As shown in FIG. 16, among others, the dampening tank 210 can be disposed, at least partially, in the second cavity 1314 defined by the pad 208. For example, the tank body 1402 can be disposed in the second cavity 1314. The lower tank surface 1406 can interface with the ridge 1320 of the pad 208. With the dampening tank 210 coupled with the post 204, the dampening tank 210 can retain the position of the pad via the ridge 1320. For example, the dampening tank 210 can prevent movement of the pad 208 (e.g., translational movement) relative to the post 204. In some embodiments, the tank connector 1412 can extend from the tank body 1402 and into the first cavity 1308. Disposing the tank body 1402 in the second cavity 1314 provides additional room for a larger tank body 1402, while maintaining thicker padding 208 around the post body 802 to receive the force (e.g., strikes from a user).

Figure 17:
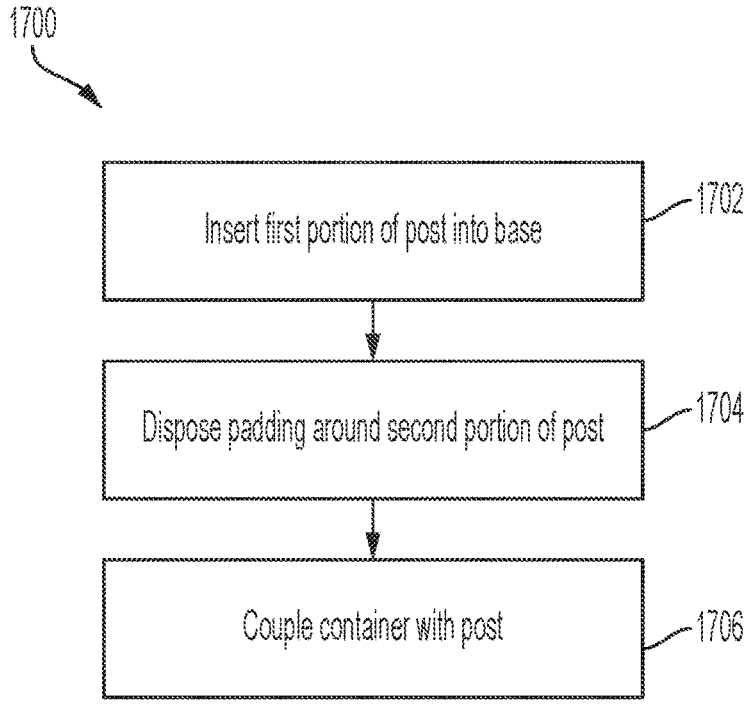
FIG. 17 is a method of assembling the exercise apparatus of FIG. 1 and FIG. 7.

Referring to FIG. 17, a method 1700 for assembling an exercise apparatus 100 is shown, according to an exemplary embodiment. Method 1700 can include inserting a first portion of a post into a base (step 1702). For example, the first portion can be a post anchor 812 of post 204. The post anchor 812 can be disposed in a base 202. The base 202 can include a first base portion (e.g., top base portion 302) and a second base portion (e.g., bottom base portion 304). The first base portion can be disposed on top of the second base portion to keep the second base portion stationary relative to the first base portion. At least one of the first and second base portions can include a reservoir and at least one of the first and second base portions can include a handle. For example, the top base portion 302 can include the reservoir (e.g., bottom base reservoir 606) and the bottom base portion 304 can include the handle (e.g., anchor point 308). In some embodiments, the top base portion 302 can include the reservoir (e.g., top base reservoir 602) and the bottom base portion 304 can include the handle (e.g., anchor point 308). Step 1702 can include filling the reservoir, at least partially, with a filler (e.g., water, gel, sand, etc.).

The base 202 can include a receptacle 610 to receive the post anchor 812. The receptacle 610 can be disposed in the first base portion (e.g., top base portion 302). The post anchor 812 can have a first diameter (e.g., anchor diameter 814). The receptacle 610 can have a second diameter (e.g., receptacle diameter 612). The first diameter can be less than the second diameter to facilitate a predetermined angle of deflection of the post 204. The predetermined angle of deflection can be between 2 and 10 degrees, or between 5 and 10 degrees. The anchor diameter 814 and/or the receptacle diameter 612 can be based on the predetermined angle of deflection. Step 1702 can include disposing a diaphragm 206 around the post anchor 812. The diaphragm 206 can couple with the post 204. The diaphragm 206 can couple with the base 202. The diaphragm 206 can secure the post 204 to the base 202 and still allow the post 204 to move (e.g., deflect) relative to the base 202.

Method 1700 can include disposing a pad around a second portion of the post 204 (step 1704). For example, the second portion can be the post body 802. The pad 208 can be disposed around the post body 802. For example, the pad 208 can define a first cavity 1308. The post body 802 can be disposed in the first cavity 1308.

Method 1700 can include coupling a tank with the post 204 (step 1706). For example, the dampening tank 210 can couple with the post 204. The dampening tank 210 can couple with the post 204 at a distal end opposite the base 202. The dampening tank 210 can threadably couple with the post 204. The pad 208 can extend from the base to the dampening tank 210. The pad 208 can define a second cavity 1314. The dampening tank 210 can be disposed in the second cavity 1312. The first cavity 1308 can have a first cavity diameter 1312. The second cavity 1314 can have a second cavity diameter 1318. The first cavity diameter 1312 can be less than the second cavity diameter 1318. The pad 208 can define a ridge 1320. A lower tank surface 1406 of the dampening tank 210 can interface with the ridge 1320. The dampening tank 210 can prevent translational movement of the pad 208 relative to the post 204.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining can be stationary (e.g., permanent or fixed) or moveable (e.g., removable or releasable). Such joining can be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling can be mechanical, electrical, or fluidic.

References herein to the positions of elements (e.g., "top," "bottom," "above," "below") are merely used to describe the orientation of various elements in the FIGURES. It should be noted that the orientation of various elements can differ according to other exemplary It is important to note that any element disclosed in one embodiment can be incorporated or utilized with any other embodiment disclosed herein.

What is claimed is:

1. An exercise apparatus, comprising:

a base;

a post comprising a first portion and a second portion, the base configured to receive the first portion of the post;

a pad disposed around the second portion of the post; and a tank removably coupled with the post at a distal end of the post opposite the base, the pad extending from the base to the tank.

2. The exercise apparatus of claim 1, further comprising:

a flexible diaphragm disposed around the first portion of the post, the flexible diaphragm disposed at least partially between the post and the base, the flexible diaphragm to allow the post to move relative to the base.

3. The exercise apparatus of claim 1, wherein the base comprises a receptacle to receive the first portion of the post, the first portion of the post comprising a first diameter and the receptacle comprising a second diameter, the first diameter being less than the second diameter to facilitate a predetermined angle of deflection of the post.

4. The exercise apparatus of claim 3, wherein the predetermined angle of deflection is between 5 and 10 degrees.

5. The exercise apparatus of claim 1, wherein the pad defines a first cavity and a second cavity, the second portion of the post disposed in the first cavity and the tank disposed in the second cavity, the first cavity having a first cavity diameter and the second cavity having a second cavity diameter, the first cavity diameter less than the second cavity diameter.

6. The exercise apparatus of claim 1, wherein:

the pad defines a ridge; and when the tank is coupled with the post, the tank interfaces with the ridge to prevent translational movement of the pad relative to the post.

7. The exercise apparatus of claim 6, wherein the tank is threadably coupled with the post.

8. The exercise apparatus of claim 1, wherein the base comprises:

a first base portion defining a receptacle; and a second base portion, wherein at least one of the first base portion and the second base portion comprises a reservoir, and wherein at least one of the first base portion and the second base portion comprises an anchor point.

9. The exercise apparatus of claim 1, wherein the tank comprises:

a tank reservoir to receive a fluid to dampen an effect of a force applied to the exercise apparatus; and an inlet disposed on a top surface of the tank to provide a path for the fluid to enter or exit the tank reservoir, wherein the tank is configured to prevent translational movement of the pad relative to the post, and wherein a majority of the tank reservoir is positioned above the distal end of the post.

10. The exercise apparatus of claim 1, wherein the base comprises a base reservoir to retain a first filler.

11. The exercise apparatus of claim 10, wherein the tank comprises a tank reservoir to retain a second filler.

12. The exercise apparatus of claim 11, wherein the post comprises a post reservoir that extends through the first portion and the second portion of the post, the post reservoir to retain a third filler.

13. A method, comprising:

inserting a first portion of a post into a base;

disposing a pad around a second portion of the post; and removably coupling a tank with the post, wherein the tank is disposed at a distal end of the post opposite the base and the pad extends from the base to the tank.

14. The method of claim 13, comprising:

disposing a flexible diaphragm around the first portion of the post;

coupling the flexible diaphragm with the post; and coupling the flexible diaphragm with the base, wherein the flexible diaphragm is configured to allow the post to move relative to the base.

15. The method of claim 13, wherein the base comprises a receptacle to receive the first portion of the post, the first portion comprising a first diameter and the receptacle comprising a second diameter, the first diameter being less than the second diameter to facilitate a predetermined angle of deflection of the post.

16. The method of claim 15, wherein the predetermined angle of deflection is between 5 and 10 degrees.

17. The method of claim 13, wherein the pad defines a first cavity and a second cavity, the method further comprising:

positioning the pad around the second portion of the post such that the second portion is in the second cavity;

coupling the tank with the post such that the tank is positioned in the first cavity;

wherein the first cavity has a first cavity diameter and the second cavity has a second cavity diameter, the first cavity diameter less than the second cavity diameter.

18. The method of claim 13, wherein the pad defines an inner ridge, the method further comprising interfacing a bottom surface of the tank with the inner ridge, such that the tank prevents translational movement of the pad relative to the post.

19. The method of claim 13, wherein the base comprises a first base portion and a second base portion, the first base portion comprising a reservoir and the second base portion comprising a handle.

20. The method of claim 13, wherein the base comprises a first base portion and a second base portion, the method further comprising:

disposing the first portion of the post in a receptacle of the first base portion, the first base portion comprising a first base reservoir and a handle; and coupling the second base portion with the first base portion, the second base portion comprising a second base reservoir.

21. An exercise apparatus, comprising:

a base;

a post comprising a first portion and a second portion, the base configured to receive the first portion of the post;

a pad disposed around the second portion of the post, wherein the pad defines a ridge; and a tank coupled with the post at a distal end of the post opposite the base, the pad extending from the base to the tank, and wherein when the tank is coupled with the post, the tank interfaces with the ridge to prevent translational movement of the pad relative to the post.

22. The exercise apparatus of claim 21, wherein the tank is threadably coupled with the post.

23. A method, comprising:

inserting a first portion of a post into a base;

disposing a pad around a second portion of the post, wherein the pad defines an inner ridge; and coupling a tank with the post, wherein the tank is disposed at a distal end of the post opposite the base and the pad extends from the base to the tank;

interfacing a bottom surface of the tank with the inner ridge, such that the tank prevents translational movement of the pad relative to the post.

* * * * *